US008554094B2

(12) United States Patent
Sakai

(10) Patent No.: US 8,554,094 B2
(45) Date of Patent: Oct. 8, 2013

(54) IMAGE FORMING APPARATUS AND IMAGE QUALITY CONTROL METHOD

(75) Inventor: Tetsuro Sakai, Saitama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 255 days.

(21) Appl. No.: 13/170,041

(22) Filed: Jun. 27, 2011

(65) Prior Publication Data

US 2012/0002991 A1 Jan. 5, 2012

Related U.S. Application Data

(60) Provisional application No. 61/361,362, filed on Jul. 2, 2010.

(51) Int. Cl.
*G03G 15/00* (2006.01)

(52) U.S. Cl.
USPC ..... 399/49; 399/27; 399/74; 399/138

(58) Field of Classification Search
USPC ..... 399/49, 27, 74, 138
See application file for complete search history.

(56) References Cited

U.S. PATENT DOCUMENTS

| | | | | |
|---|---|---|---|---|
| 5,893,010 | A | 4/1999 | Nagashima et al. | |
| 5,950,040 | A * | 9/1999 | Mestha et al. | 399/46 |
| 2009/0129800 | A1 * | 5/2009 | Omelchenko et al. | 399/49 |
| 2011/0026981 | A1 | 2/2011 | Sakai | |

FOREIGN PATENT DOCUMENTS

| | | | |
|---|---|---|---|
| JP | 10-90993 | A | 4/1989 |
| JP | 2007-322974 | A | 12/2007 |

* cited by examiner

*Primary Examiner* — Walter L Lindsay, Jr.
*Assistant Examiner* — Roy Y Yi
(74) *Attorney, Agent, or Firm* — Patterson & Sheridan, L.L.P.

(57) ABSTRACT

Certain embodiments provide an image forming apparatus including a photoconductor, a latent image forming portion, an image processing portion, a developer, a transferred body, a sensor that detects an image density of a toner image by the amount of toner attached to a surface and has a sensor characteristic in which a sensor output substantially monotonously decreases according to an increase in the amount of toner, a nonlinear amplifier that has a nonlinear amplification characteristic having one or more inflection points, and enlarges and corrects a value read by the sensor in a range where the sensor output monotonously decreases with respect to the amount of toner by amplification, and an image quality control portion that controls a forming condition of an electrostatic latent image using a correction value of a variation amount of the value at a side where the amount of toner is large in the range.

20 Claims, 12 Drawing Sheets

IMAGE FORMING APPARATUS AND IMAGE QUALITY CONTROL METHOD

CROSS-REFERENCE TO RELATED APPLICATION

The present application claims priority under 35 U.S.C. 119 to U.S. Provisional Application Ser. No. 61/361,362, to Sakai, filed on Jul. 2, 2010, the entire disclosure of which is incorporated herein by reference.

FIELD

Exemplary embodiments described herein relate to an image forming apparatus and an image quality control method.

BACKGROUND

An image density of a toner image printed on a belt varies depending on circumstances such as temperature or humidity inside or outside an apparatus. The image density of a toner image indicates a value obtained by dividing the gross weight of toner on a region by the area of the region. An image forming apparatus maintains image quality such that the image density does not vary.

The image forming apparatus patterns a toner image for density adjustment on the belt. The image forming apparatus detects an attached toner amount of the toner image using an optical sensor. The image forming apparatus detects the image density of the toner image based on the attached toner amount.

The sensor outputs different voltages according to a toner amount based on an amount of reflected light. The image forming apparatus obtains the attached toner amount based on the sensor output voltage.

The sensor has input and output characteristics. A transverse axis in the sensor characteristics denotes an attached toner amount. A longitudinal axis denotes a sensor output voltage. In a curve indicating the characteristics, the sensor output voltage decreases downward to the right according to an increase in the attached toner amount.

However, a controller cannot read the sensor output voltage with high accuracy in a range where the attached toner amount is large on the curve.

On the curve, a variation amount of a value read by the sensor is great at a side where the attached toner amount is smaller. The variation amount of a value read by the sensor is very small at a side where the attached toner amount is larger.

The image forming apparatus connects an A/D (analog to digital) converter to an output side of the sensor. The A/D converter A/D converts the variation amount, for example, in a quantization step of 1/256.

A variation amount of a value read by the sensor is very small at a side where the image density is higher, that is, the attached toner amount is larger.

The image forming apparatus is difficult to analyze an output from the A/D converter. The image forming apparatus cannot obtain a value read by the sensor with high accuracy at a side where the image density is higher.

DETAILED DESCRIPTION

Figure 1:
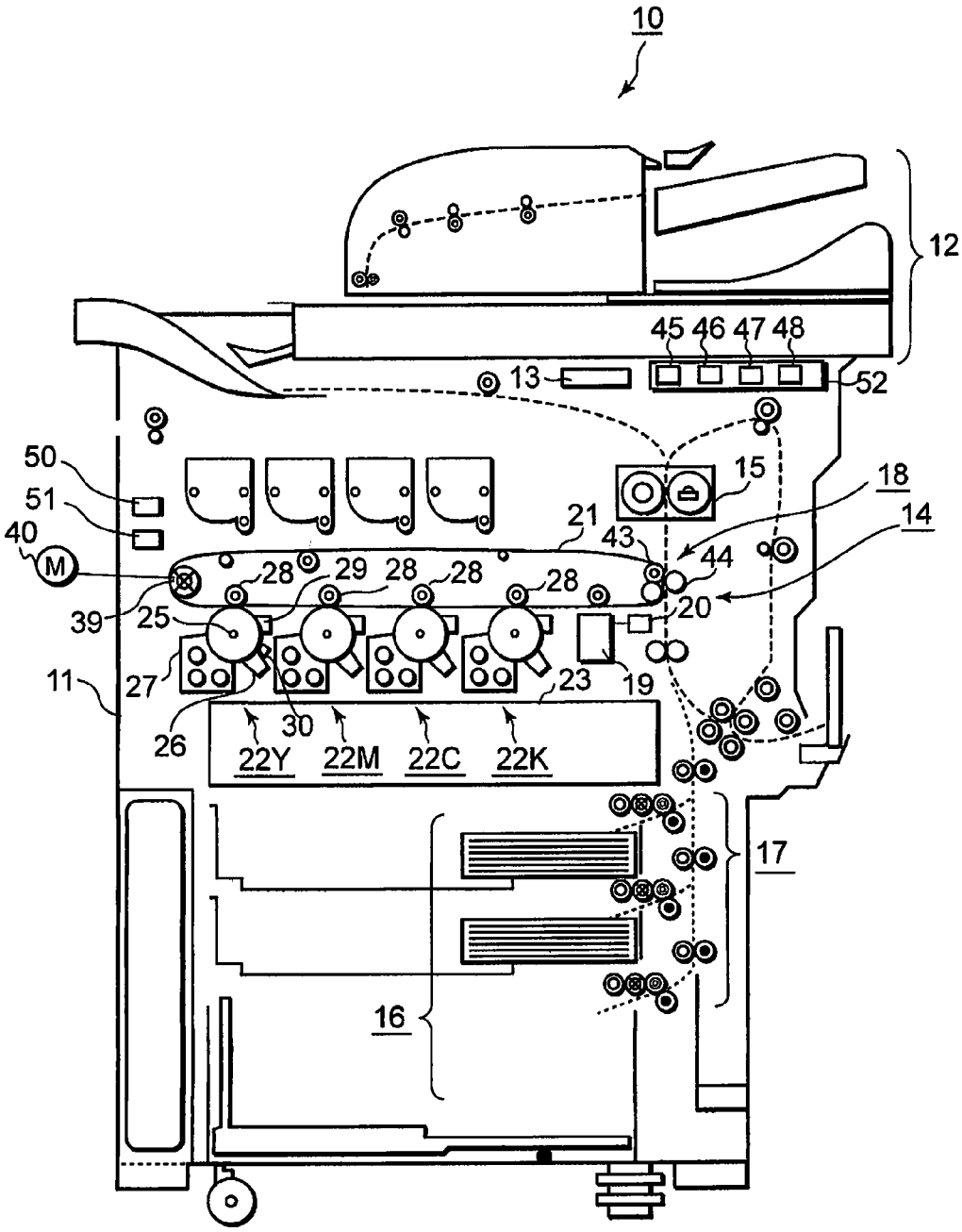
FIG. 1 is a configuration diagram of an image forming apparatus according to a first embodiment.

Certain embodiments provide an image forming apparatus comprising: a photoconductor operable to rotate; a latent image forming portion configured to electrically charge the photoconductor and forms an electrostatic latent image on a surface of the photoconductor; an image processing portion configured to generate image data or pattern data; a developer configured to develop the electrostatic latent image of the image data or the pattern data using toner; a transferred body configured to have a surface onto which a toner image on the photoconductor is transferred; a sensor configured to detect an image density of the toner image according to the amount of toner attached to the surface, and have a sensor characteristic in which a sensor output substantially monotonously decreases according to an increase in the amount of toner; a nonlinear amplifier configured to have a nonlinear amplification characteristic having one or more inflection points, and enlarge and correct a value read by the sensor in a range where the sensor output monotonously decreases with respect to the amount of toner by amplification; and an image quality control portion configured to control forming conditions of the electrostatic latent image by the latent image forming portion, using a correction value of a variation amount of the value read by the sensor, the value being output from the nonlinear amplifier, at a side where the amount of toner is large in the range.

Hereinafter, an image forming apparatus and an image quality control method will be described in detail using the accompanying drawings as examples. In addition, the same part is given the same reference numeral in each drawing, and repeated description will be omitted.

First Embodiment

An image forming apparatus according to the first embodiment is an MFP (Multi Function Peripheral).

An image quality control method according to the first embodiment is a method in which the amount of toner to be attached is detected based on image density of a pattern on a transfer belt, and image quality is controlled to be maintained stably according to the amount.

Figure 2:
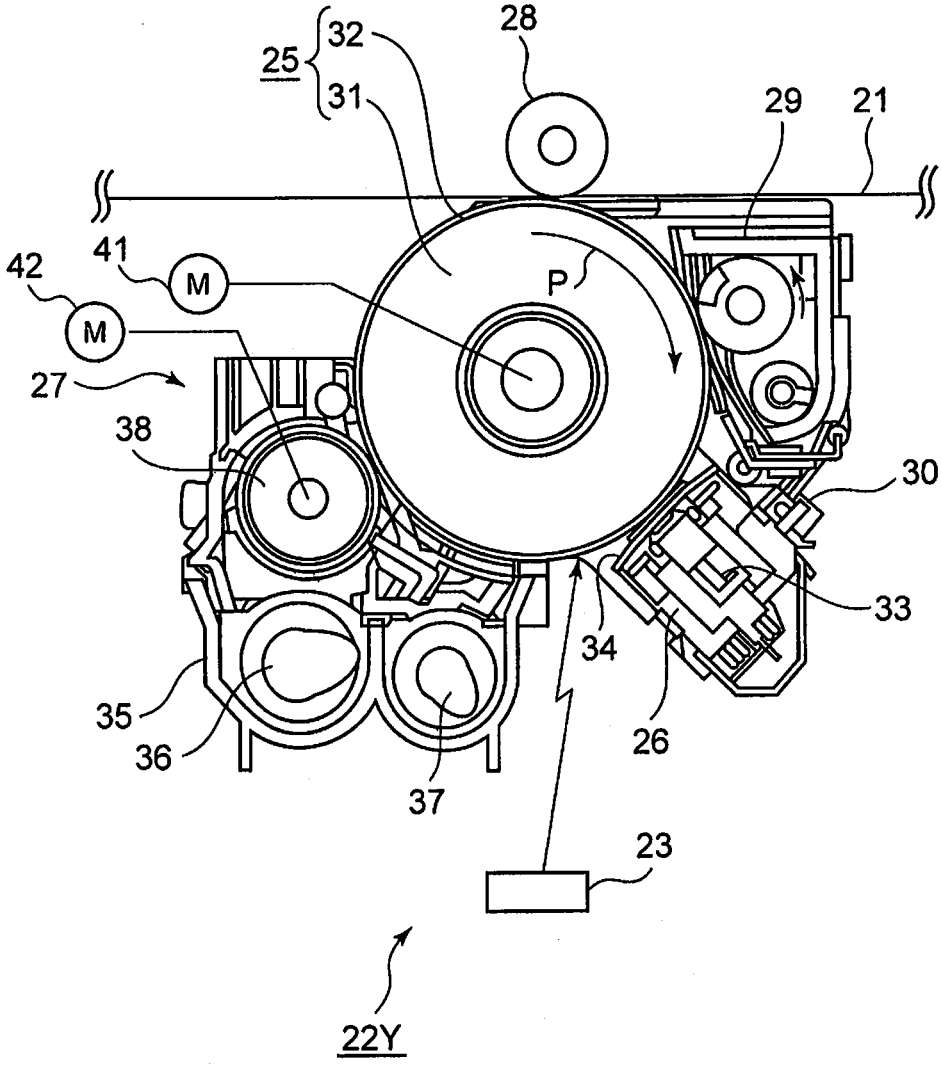
FIG. 2 is a diagram illustrating a configuration example of an image forming portion used in the image forming apparatus according to the first embodiment.

FIG. 1 is a configuration diagram of the MFP. FIG. 2 is a diagram illustrating a configuration example of an image forming portion. The same reference numerals denote the same elements in FIGS. 1 and 2.

The MFP 10 includes a main body 11, a scanner 12, an image processing portion 13, a printing process portion 14, a fixing portion 15, a paper feeding portion 16, a carrying mechanism 17, a secondary transfer portion 18, a attached toner amount sensor 19 (sensor), a nonlinear amplifier 20, and a controller 52.

The scanner 12 scans a surface of an original document and outputs image data. The image processing portion 13 generates image data and pattern data.

The printing process portion 14 forms an image on a sheet and outputs the sheet. The fixing portion 15 fixes an image, which is not fixed yet, onto a sheet.

The printing process portion 14 includes a belt 21 (transferred body), a yellow (Y) image forming portion 22Y, a magenta (M) image forming portion 22M, a cyan (C) image forming portion 22C, a black (K) image forming portion 22K, and a laser exposure device 23 (latent image forming portion).

The belt 21 is a transferred body having a surface onto which a toner image on a photoconductor 32 is transferred. A driving roller 39 drives the belt 21. A belt motor 40 rotates the driving roller 39.

The image forming portion 22Y has, as shown in FIG. 2, a photoconductive drum 25, a charger 26, a developer 27, a primary transfer roller 28, a cleaner 29, and a neutralizer 30.

The photoconductive drum 25 includes a drum 31 which rotates about an axis in a drum rotation direction (the arrow P direction), and the photoconductor 32 on the outer circumferential surface of the drum 31. A drum motor 41 rotates the drum 31.

The charger 26 electrically charges the photoconductor 32 by generating corona discharging in a wire 33. The charger 26 enables the corona discharging to be stable by changing charged amounts on the photoconductor 32 using a grid bias voltage from a grid electrode 34.

The laser exposure device 23 forms an electrostatic latent image on the surface of the photoconductor 32 using exposure by exposure data. Laser light beams of a certain color reduce a charging potential of a part to which the laser light beams are applied, on the surfaces of the four photoconductors 32.

The charger 26 and the laser exposure device 23 constitute a latent image forming portion. The laser exposure device 23 and the charger 26 electrically charge the photoconductor 32 and form an electrostatic latent image on the surface of the photoconductor 32.

The developer 27 develops the electrostatic latent image on the photoconductor 32 at a developing bias potential. The developer 27 has a container 35 with which a two-component developing agent is filled. The developer 27 includes mixers 36 and 37 and a magnet roller 38 inside the container 35.

A developing motor 42 rotates one or both of the mixers 36 and 37 and the magnet roller 38.

The developer 27 enables a magnetic brush to come into contact with the outer circumferential surface of the photoconductive drum 25. The developer 27 supplies toner to the electrostatic latent image through the rotation of the magnet roller 38 and the photoconductive drum 25.

Further, the primary transfer roller 28 transfers the toner image on the photoconductive drum 25 onto the belt 21 downstream of the drum rotation direction. The cleaner 29 removes toner remaining on the photoconductive drum 25 after the primary transfer.

The neutralizer 30 is an LED (Light Emitting Diode) which removes charge on the photoconductive drum 25.

Configurations of the image forming portions 22M, 22C and 22K are substantially the same as the configuration of the image forming portion 22Y.

The paper feeding portion 16 in FIG. 1 has cassettes. The paper feeding portion 16 sets sheets in the respective cassettes. The carrying mechanism 17 supplies a sheet from the paper feeding portion 16 to the printing process portion 14.

The secondary transfer portion 18 transfers a toner image on the belt 21 onto the sheet. The secondary transfer portion 18 includes a backup roller 43 and a secondary transfer roller 44.

The secondary transfer portion 18 secondarily transfers a color toner image onto the sheet by applying a transfer bias to the backup roller 43.

The attached toner amount sensor 19 is a sensor which detects an image density of a toner image according to the amount of toner attached to the surface of the belt 21. The amount of toner is indicated by, for example, $mg/cm^2$.

Figure 3A:
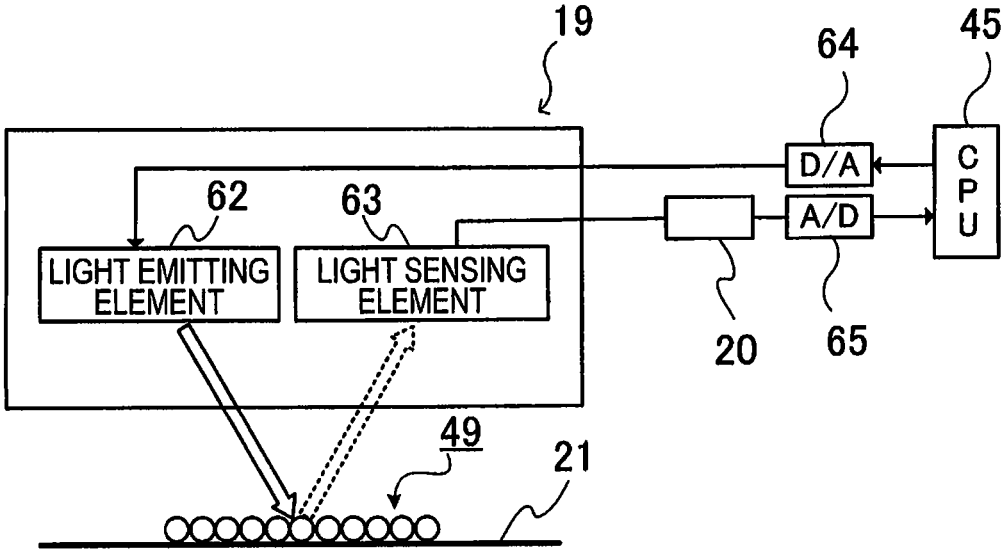
FIG. 3A is a diagram illustrating a configuration example of a sensor used in the image forming apparatus according to the first embodiment.

FIG. 3A is a diagram illustrating a configuration example of the attached toner amount sensor 19. Further, FIG. 3A also shows the nonlinear amplifier 20 and a CPU 45. The above-described reference numerals denote the same elements in the figure.

The attached toner amount sensor 19 includes a light emitting element 62 and a light sensing element 63. The light emitting element 62 is a near infrared LED. The light sensing element 63 is a near infrared photo transistor.

The light sensing element 63 senses reflection light beams from a toner image of a certain color on the belt 21. The light sensing element 63 detects a reflection light amount of the magnitude according to an image density of the toner image by the reflection light beams.

The light sensing element 63 outputs a photocurrent. The light sensing element 63 has a configuration in which, for example, a collector of the photo transistor is pulled up, and an emitter thereof is connected to the ground via a resistor. The light sensing element 63 extracts a voltage signal from a connection point of the emitter and the resistor.

The MFP 10 has a D/A (digital to analog) converter 64 which is connected to the input side of the light emitting element 62. The MFP 10 has the CPU 45 which is connected to the input side of the D/A converter 64. The CPU 45 controls output power of light beams from the light emitting element 62 by control signals.

Figure 3B:
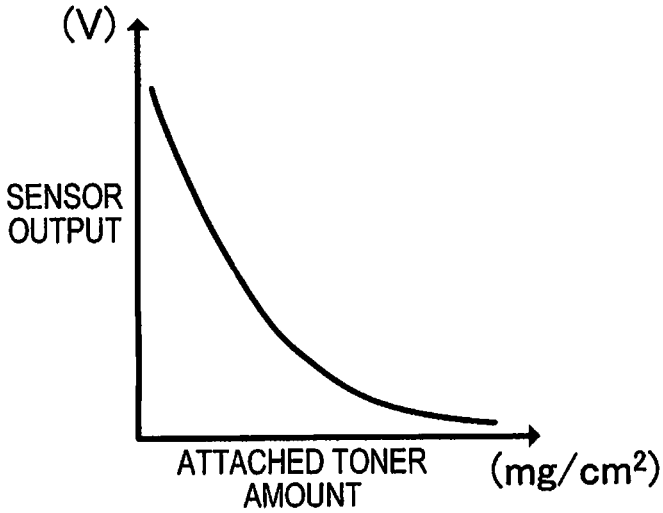
FIG. 3B is a diagram illustrating an example of a sensor characteristic of the sensor used in the image forming apparatus according to the first embodiment.

FIG. 3B is a diagram illustrating an example of a sensor characteristic of the attached toner amount sensor 19.

The sensor characteristic of the attached toner amount sensor 19 has a characteristic in which in a relationship between a toner amount and a sensor output voltage, the sensor output voltage substantially monotonously decreases according to an increase in the toner amount. In the sensor characteristic, the sensor output has a downwardly protruding shape with respect to the increase in the toner amount.

Further, the MFP 10 has the nonlinear amplifier 20 which is connected to the output side of the light sensing element 63. The MFP 10 has an A/D converter 65 which is connected to the output side of the nonlinear amplifier 20. The MFP 10 connects the CPU 45 to the output side of the A/D converter 65.

The nonlinear amplifier 20 amplifies the voltage signal from the attached toner amount sensor 19.

Figure 4A:
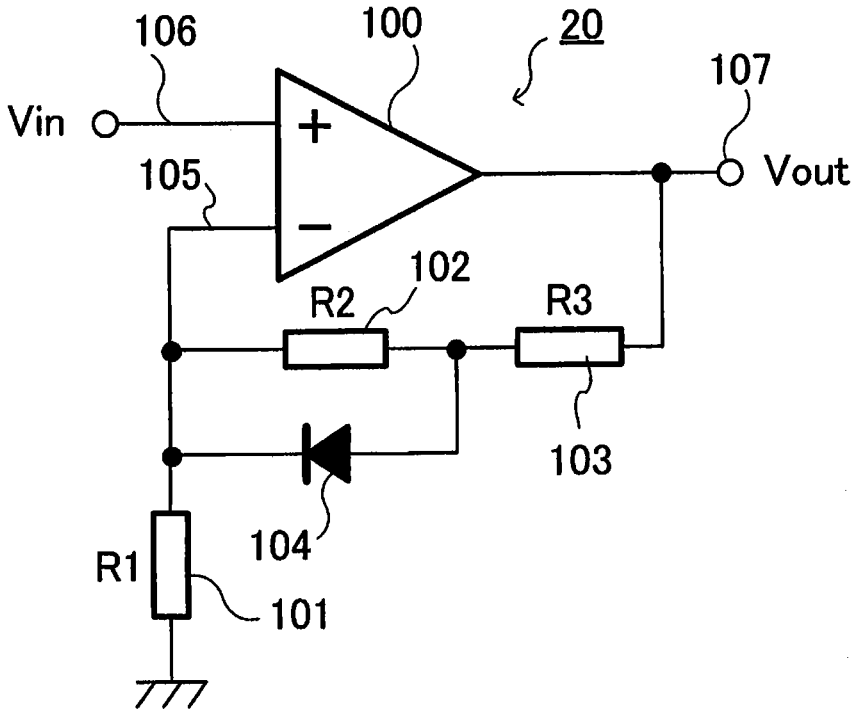
FIG. 4A is a diagram illustrating a configuration example of a nonlinear amplifier used in the image forming apparatus according to the first embodiment.

FIG. 4A is a diagram illustrating a configuration example of the nonlinear amplifier 20.

The nonlinear amplifier 20 includes an operational amplifier 100, a resistor 101 (first resistor), a resistor 102 (second resistor), a resistor 103 (third resistor), and a diode 104 (clipping element).

The operational amplifier 100 receives the voltage signal output from the sensor via a non-inverting input terminal 106. The operational amplifier 100 refers to a signal after being amplified using an output terminal 107.

The operational amplifier 100 connects the resistor 101 to an inverting input terminal 105. The other end of the resistor 101 is connected to the ground.

The nonlinear amplifier 20 has the resistors 102 and 103 connected between the inverting input terminal 105 and the output terminal 107. The resistors 102 and 103 are connected in series to each other.

The nonlinear amplifier 20 connects an anode of the diode 104 between the resistors 102 and 103. The nonlinear amplifier 20 connects a cathode of the diode 104 to the contact point of the resistor 101 and the inverting input terminal 105.

The diode 104 performs clipping. The clipping indicates switching between conduction and non conduction due to a voltage level.

Figure 4B:
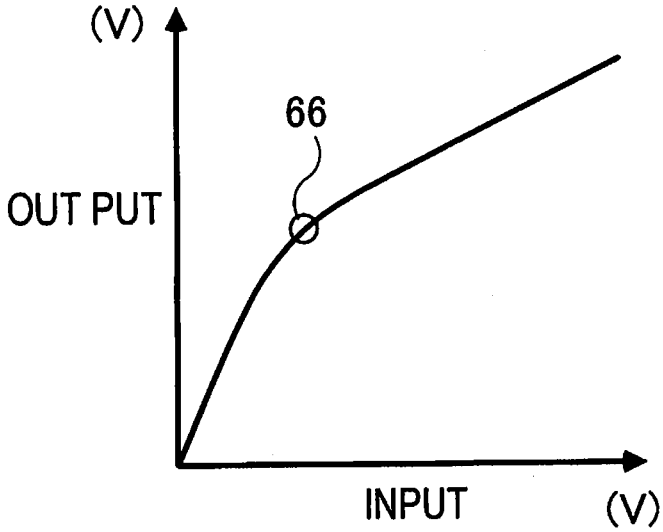
FIG. 4B is a diagram illustrating an example of an amplification characteristic of the nonlinear amplifier used in the image forming apparatus according to the first embodiment.

FIG. 4B is a diagram illustrating an example of an amplification characteristic of the nonlinear amplifier 20. The nonlinear amplifier 20 has a nonlinear amplification characteristic which has one inflection point 66.

The inflection point 66 indicates a point at which the second derivative of the characteristic curve becomes 0. Alternatively, the inflection point 66 indicates a point at which signs of the second derivative of the characteristic curve are changed.

The nonlinear amplifier 20 enlarges and corrects a value read by the sensor in a range where the sensor output monotonously decreases with respect to the toner amount by the amplification.

The amplification characteristic has different slopes in the left side of the inflection point 66 and the right side of the inflection point 66. An amplification factor of the nonlinear amplifier 20 is nonlinear with respect to the sensor output voltage.

A first amplification factor of the operational amplifier 100 is larger in a range where the sensor output voltage is small. The operational amplifier 100 has a second amplification factor smaller than the first amplification factor in a range where the sensor output voltage is large.

The controller 52 in FIG. 1 includes the CPU (Central Processing Unit) 45, a ROM (Read Only Memory) 46, a RAM (Random Access Memory) 47, and a motor driving portion 48.

The controller 52 functions as an image quality control portion 55. The controller 52 reads the output from the nonlinear amplifier 20.

The controller 52 controls a forming condition of an electrostatic latent image by the charger 26 and the laser exposure device 23, using a correction value of a variation amount of a value read by the sensor, which is output from the nonlinear amplifier 20, at a side where the amount of toner is large in the above-described range.

The controller 52 also controls a condition of an image forming process. The condition of an image forming process indicates a condition in which a fixing condition and the like are added to the forming condition of an electrostatic latent image.

Figure 5:
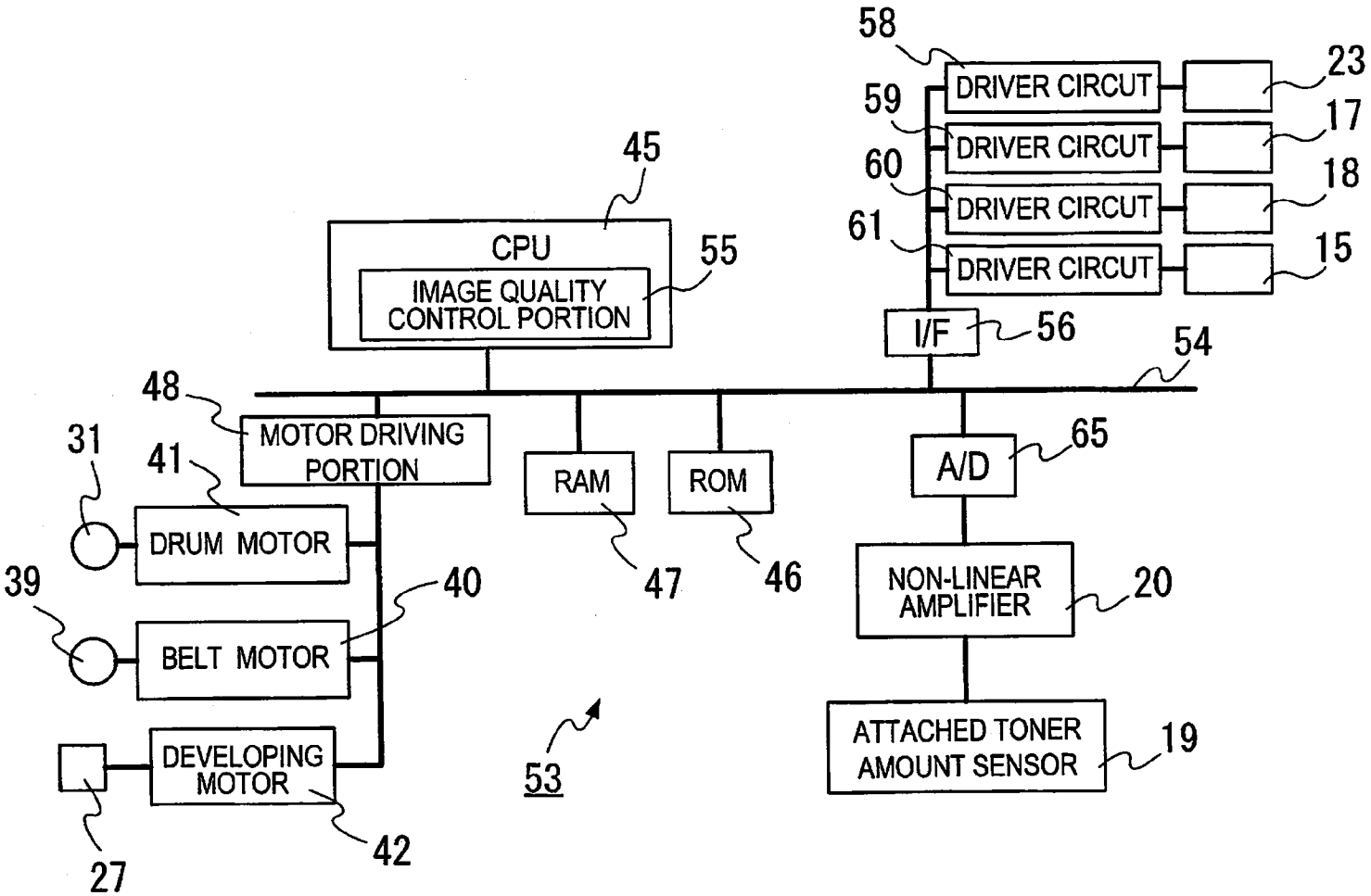
FIG. 5 is a block diagram illustrating a control system used in the image forming apparatus according to the first embodiment.

FIG. 5 is a block diagram illustrating a control system of which a control function of maintaining image quality attracts attention. The above-described reference numerals denote the same elements in the figure.

A control system 53 includes the CPU 45, the ROM 46, the RAM 47, the motor driving portion 48, and A/D converter 65, which are connected to a bus 54.

The CPU 45 loads a program stored in the ROM 46 to the RAM 47. The CPU 45 executes the program, and thereby the controller 52 performs the function as the image quality control portion 55.

The motor driving portion 48 controls a rotation speed of the drum motor 41. The drum motor 41 rotates the respective drums 31 of the four photoconductive drums 25. The motor driving portion 48 drives the belt motor 40. The motor driving portion 48 drives the developing motor 42.

Further, the controller 52 (FIG. 1) allocates a pattern region of a toner image for density measurement on the belt 21. The controller 52 allocates each pattern such that toner images of the respective colors do not overlap with each other in a traveling direction of the belt 21.

As an example, the controller 52 enables a line of rectangular toner images patterned in order of yellow, magenta, cyan, and black, to be generated on the belt 21. The printing process portion 14 forms a line of the rectangular toner images on the belt 21.

The control system 53 enables data or control signals to be input to and output from driver circuits 58, 59, 60 and 61 via an interface portion 56.

The driver circuit 58 is used to drive the laser exposure device 23. The driver circuit 59 is used to drive the carrying mechanism 17 and controls a carrying speed of a sheet. The driver circuit 60 is used to drive the printing process portion 14 and controls the transfer bias, the developing bias, and the like. The driver circuit 61 is used to drive the fixing portion 15 and controls a fixing temperature and a fixing time.

In addition, the MFP 10 has a high voltage power supply portion 50 and a low voltage power supply portion 51.

The high voltage power supply portion 50 supplies the charging bias voltage to the wire 33. The high voltage power supply portion 50 supplies the grid bias voltage to the grid electrode 34. The high voltage power supply portion 50 supplies the developing bias voltage to the magnet roller 38. The high voltage power supply portion 50 supplies the transfer bias voltage to the primary transfer roller 28.

The low voltage power supply portion 51 supplies a low voltage to the electronic circuits, the motors, and the sensor.

The MFP 10 with the above-described configuration reads an attached toner amount when the main body 11 is powered on, pre-run, or the like.

Figure 6:
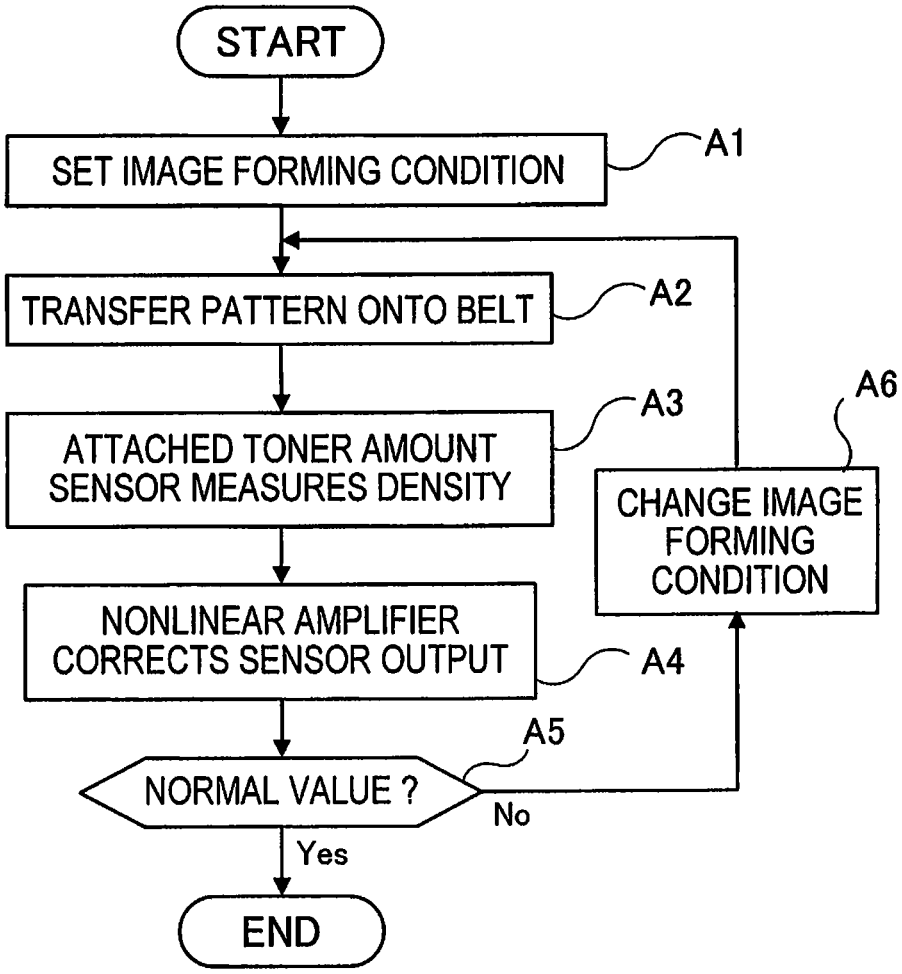
FIG. 6 is a flowchart illustrating an image quality control method according to the first embodiment.

FIG. 6 is a flowchart illustrating an image quality control method according to the first embodiment.

In ACT A1, the controller 52 reads reference image forming conditions from the ROM 46. The reference image forming conditions are reference setting values of a charging voltage, a laser exposure amount, a developing bias, and the like.

The controller 52 sets parameter values such as a voltage, a time, and a speed in each constituent element such as scanner 12, the printing process portion 14, or the fixing portion 15.

In ACT A1, the controller 52 inputs signals for controlling a reading timing and the like to the light emitting element 62 and the light sensing element 63 of the attached toner amount sensor 19.

In ACT A2, the controller 52 makes the printing process portion 14 perform test printing. The controller 52 starts rotating the four photoconductive drums 25.

The image forming portions 22Y, 22M, 22C and 22K respectively form electrostatic latent images on the photoconductors 32. The four developers 27 develop the electrostatic latent images on the respective photoconductors 32.

Figure 7A:
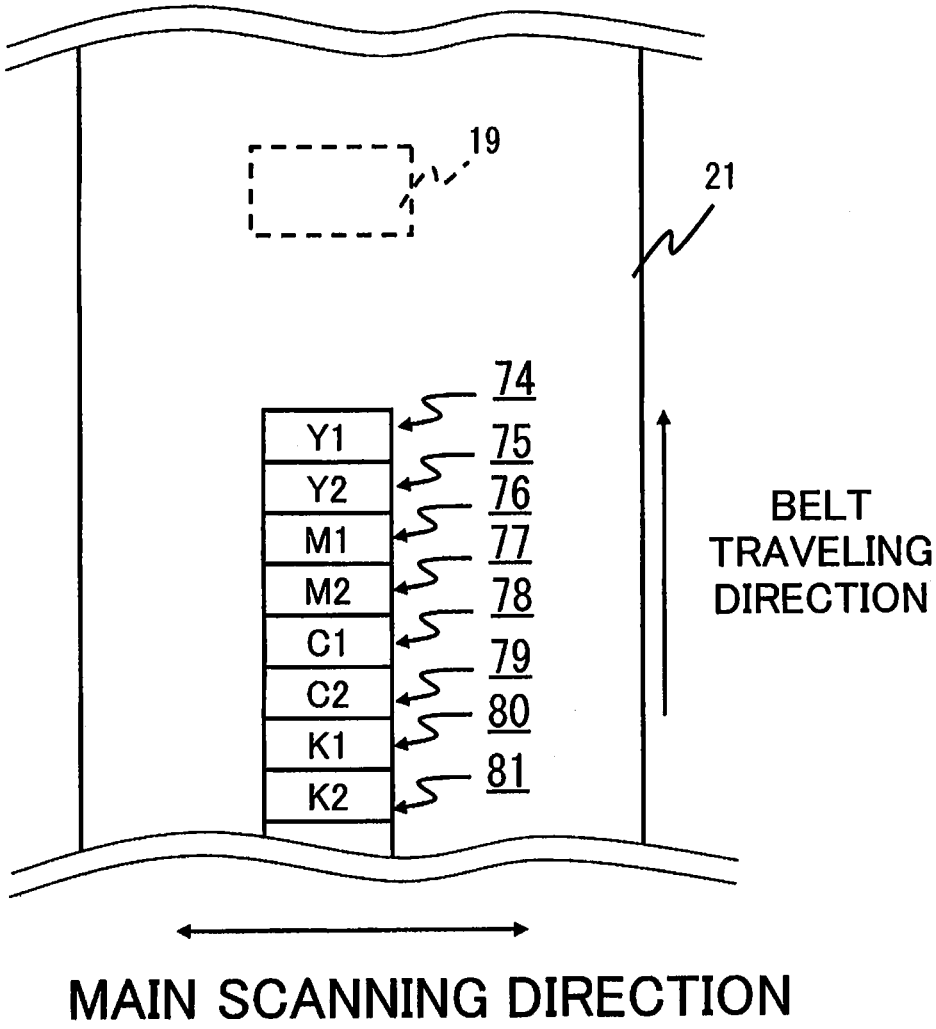
FIG. 7A is a diagram illustrating an example of toner images of four colors on a transferred body used in the image forming apparatus according to the first embodiment.

FIG. 7A is a diagram illustrating an example of toner images of four colors on the belt 21. The figure is a plan view when the belt surface of the belt 21 is seen from the lower side. The above-described reference numerals denote the same elements in the figure.

In ACT A2, the image forming portions 22Y, 22M, 22C and 22K transfer the toner images 74 to 81 onto the belt 21 along the belt traveling direction. The image forming portions 22Y, 22M, 22C and 22K print patterns of the toner images 74 to 81 at a position where the light beams from the attached toner amount sensor 19 form a spot.

The image forming portion 22Y forms the rectangular toner images 74 and 75 on the belt 21. The image density of the toner 74 is different from that of the toner image 75.

In a similar way, the image forming portions 22M, 22C and 22K respectively form the toner images 76, 77, 78, 79, 80 and 81 on the belt 21. The image densities of the toner images 76, 78 and 80 are different from those of the toner images 77, 79 and 81.

The belt 21 travels. A line of patterns move near to the attached toner amount sensor 19 which is located downstream of the traveling direction.

In ACT A3, the attached toner amount sensor 19 outputs a sensor value based on reflection light from the patterns.

For example, the attached toner amount sensor 19 uses a difference between an intensity of reflection light beams from a smooth belt surface and an intensity of irregular reflection light beams from a toner surface.

The attached toner amount sensor 19 detects to what degree the reflection light from the smooth belt surface is blocked by the toner.

In ACT A4, the nonlinear amplifier 20 corrects the sensor output.

Figure 7B:
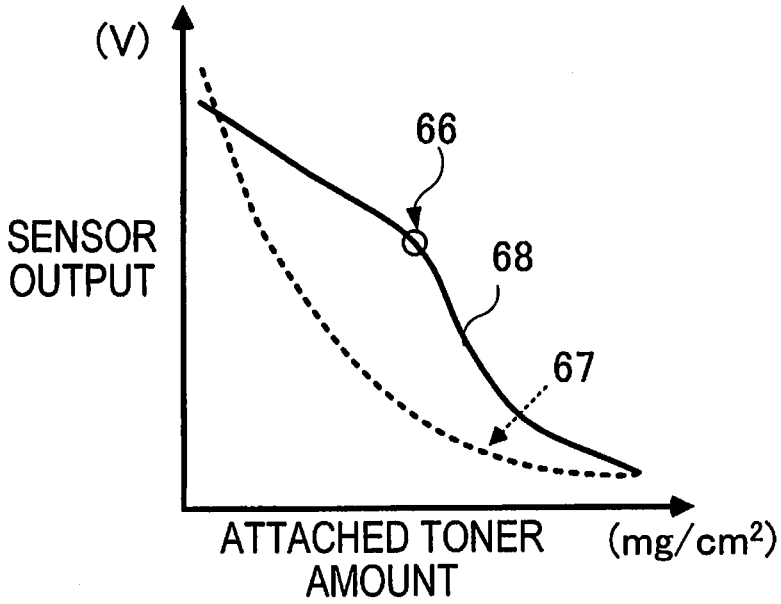
FIG. 7B is a diagram illustrating an example of an output characteristic of the nonlinear amplifier used in the image forming apparatus according to the first embodiment.

FIG. 7B is a diagram illustrating an example of an output characteristic of the nonlinear amplifier 20. The curve 68 indicates a characteristic after being corrected.

The attached toner amount on the transverse axis corresponds to an image density of a toner image. The amplification characteristic indicated by the curve 68 enlarges the sensor output characteristic indicated by the curve 67 in a range where the image density is high.

At a side where the image density is high, a variation amount of the sensor output voltage by the curve 68 is larger than a variation amount of the sensor output voltage by the curve 67.

The nonlinear amplifier 20 works as follows. In other words, if the sensor output is small, the nonlinear amplifier 20 outputs a voltage Vout expressed by the following Equation (a).

$$Vout=[1+\{(R2+R3)/R1\}]\times Vin \quad (a)$$

The voltage Vout is a feedback voltage. The feedback part of the nonlinear amplifier 20 forms a voltage divider using the resistors. The feedback voltage is expressed by the voltage division using the resistors 101, 102 and 103.

If the sensor output (that is, the input Vin of the nonlinear amplifier 20) increases to exceed Vin=(R1/R2)×Vf, the diode 104 clips the output voltage signal. As a result, the nonlinear amplifier 20 outputs a voltage Vout expressed by the following Equation (b).

$$Vout=Vf+\{1+(R3/R1)\}\times Vin \quad (b)$$

Here, R1, R2, and R3 denote resistance values of the resistors 101, 102 and 103, respectively. Vf denotes a forward voltage of the diode 104. The feedback voltage Vout is expressed by Vf, and resistance values of the resistors 101 and 103.

Figure 7C:
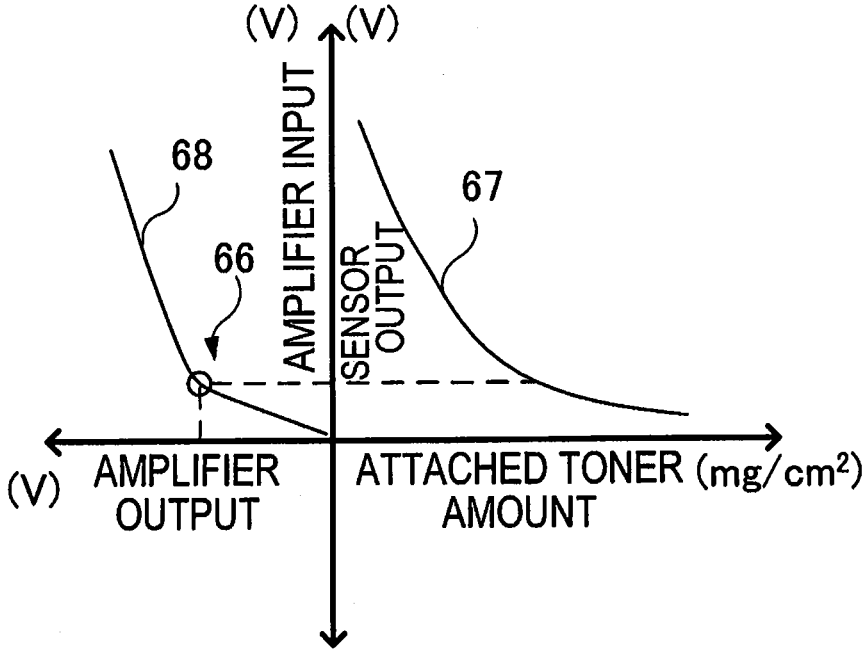
FIG. 7C is a graph illustrating a method of correcting characteristics of the sensor used in the image forming apparatus according to the first embodiment.

FIG. 7C is a graph illustrating a method of correcting the characteristics of the attached toner amount sensor 19.

The curve 67 shown in the first quadrant of the graph in FIG. 7C indicates the sensor output voltage shown in FIG. 3B. The sensor output voltage value of the curve 67 corresponds to an input of the nonlinear amplifier 20. The curve 68 shown in the second quadrant of the graph is obtained by rotating the curve shown in FIG. 4B by 90 degrees in the counterclockwise direction.

As in the curve 67, if the sensor output of the attached toner amount sensor 19 has a small value, the nonlinear amplifier 20 outputs a large value. If the attached toner amount sensor 19 outputs a value exceeding the input value of the inflection point 66, an amplified signal is clipped. The gain of the nonlinear amplifier 20 decreases.

As shown in FIGS. 7B and 7C, the MFP 10 corrects the curve 67 indicating the characteristic of the attached toner amount sensor 19.

In ACT A5 in FIG. 6, the controller 52 determines pass or failure based on the sensor value corrected by the nonlinear amplifier 20.

The ROM 46 stores an allowable range for a plurality of image densities for each color. The controller 52 records outputs from the nonlinear amplifier 20 in the RAM 47.

The controller 52 compares each of the toner images 74 to 81 with the reference value. The controller 52 determines whether or not a measured image density of each of the toner images 74 to 81 is in a predefined range.

In ACT A5, the sensor value is in a range stored in advance. The controller 52 determines it as being normal, and finishes the process through the Yes route.

In ACT A5, the sensor value is out of the range. The controller 52 determines it as being abnormal, and, the controller 52 changes the image forming condition in ACT A6 through the No route. The controller 52 performs the process in ACT A2.

Thereafter, if an original document is set in the MFP 10, the scanner 12 reads an original document surface. The printing process portion 14 transfers a color toner image onto a sheet. The fixing portion 15 fixes toner onto the sheet. The MFP 10 prints and outputs the sheet. In this way, accuracy for controlling image quality to be maintained stably is improved.

The surrounding environment of the MFP 10 varies at all times. The printing process portion 14 and the like are consumable goods. The MFP 10 resets the image forming condition according to variations in the environment or consumption.

The photoconductive drum 25 or the cleaner 29 is consumed. The degree to which consumable goods are consumed is different for each color. The image density of an electrostatic latent image or a toner image, and the widths of lines in an image are changed depending on the frequency of use of the consumable goods.

The controller 52 determines pass or failure based on the result of the comparison of the measured image density with the reference density. If the image density is in an allowable range causing no problems, the controller 52 records the image forming condition during the setting in the RAM 47.

An image forming apparatus without a nonlinear amplifier 20 is provided as a comparative example with the MFP 10.

A characteristic of the attached toner amount sensor of the image forming apparatus according to the comparative example is substantially the same as the example shown in FIG. 3B. If the attached toner amount is large, the image density is high. A variation in sensor output is small at a side where the image density is high.

The image forming apparatus according to the comparative example A/D converts an output from the attached toner amount sensor. Conversion bits in an A/D converter are, for example, 8 bits. A minimal value of the quantization step in the A/D converter of 8 bits is 1/256.

The A/D converter is difficult to read a variation amount in the attached toner amount sensor 19 at a side where a toner amount is large. The image forming apparatus according to the comparative example cannot minutely read a variation amount in a range where an attached toner amount is large.

In contrast, in the MFP 10, the CPU 45 can read a larger variation amount at a side where an image density within a monotonously decreasing range is high.

In addition, as a related technique, there is known an image forming apparatus which controls a toner amount with high accuracy by using two reference images and outputs an image with good quality. There is known an image forming apparatus which detects overall grayscale characteristics of a toner amount with respect to input grayscales with high accuracy without deviation in accuracies.

However, in the related techniques, a reading process of the sensor output is complicated, and time for the process is taken. Costs are high.

In contrast, the MFP 10 can read a sensor output in a short time with a simpler configuration. The MFP 10 can enlarge a variation amount of a sensor output if an attached toner amount is large, with a simpler configuration. A control for maintaining image quality with high accuracy is possible.

As such, the MFP 10 can read an amount which varies according to the environment with respect to a target attached toner amount, and control a condition of the image forming process.

The MFP 10 is enabled to improve detection accuracy of the attached toner amount sensor 19 at a side where an attached toner amount is large in a monotonously decreasing range. The accuracy is heightened by increasing a variation amount at a side where a toner amount is large. The MFP 10 is enabled to detect an image density with high accuracy.

In addition, the nonlinear amplifier 20 may have a modified configuration.

Figure 8:
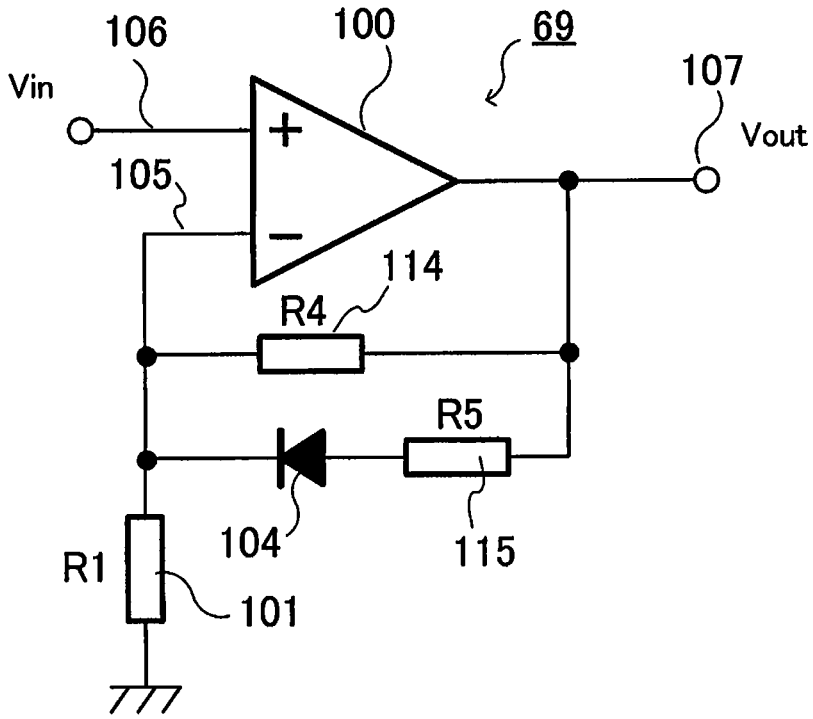
FIG. 8 is a diagram illustrating a configuration example of a nonlinear amplifier used in an image forming apparatus according to a modified example of the first embodiment.

FIG. 8 is a diagram illustrating a configuration example of a nonlinear amplifier used in an image forming apparatus according to a modified example of the first embodiment. The above-described reference numerals denote the same elements in the figure.

The nonlinear amplifier 69 connects a resistor 114 (fourth resistor) between an inverting input terminal 105 and an output terminal 107.

The nonlinear amplifier 69 connects a resistor 115 (fifth resistor) to an anode of the diode 104. In addition, the diode 104 may connect the resistor 115 to its cathode.

The nonlinear amplifier 69 has substantially the same amplification characteristic as the amplification characteristic in FIG. 4B. The nonlinear amplifier 69 has one inflection point 66 and has a nonlinear amplification characteristic. The nonlinear amplifier 69 enlarges and corrects a variation amount of a sensor value of the attached toner amount sensor 19.

Second Embodiment

The first embodiment is the best mode, however the image forming apparatus according to the embodiment may use a nonlinear amplifier having two inflection points.

An image forming apparatus according to the second embodiment is an MFP 10. An image quality control method according to the second embodiment is also a method of performing a control such that image quality is stably maintained using an attached toner amount.

The image forming apparatus according to the second embodiment has substantially the same constituent elements as the constituent elements of the MFP 10 except for the nonlinear amplifier.

Figure 9:
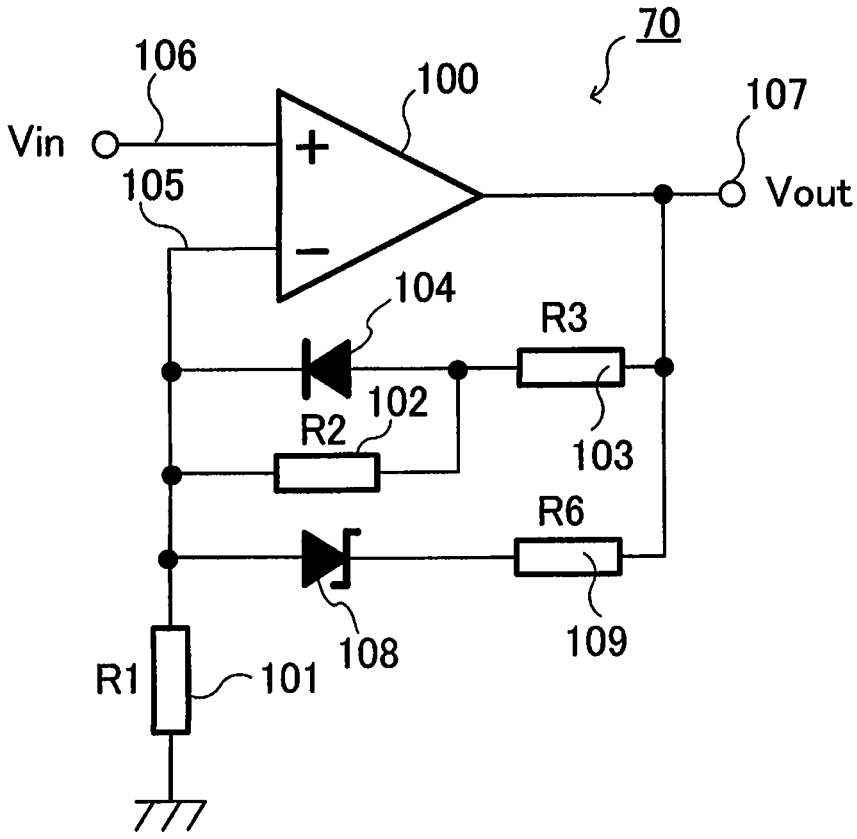
FIG. 9 is a diagram illustrating a configuration example of a nonlinear amplifier used in an image forming apparatus according to a second embodiment.

FIG. 9 is a diagram illustrating a configuration example of a nonlinear amplifier used in the image forming apparatus according to the second embodiment. The above-described reference numerals denote the same elements in the figure.

The nonlinear amplifier 70 connects a zener diode 108 and a resistor 109 (sixth resistor) between the inverting input terminal 105 and the output terminal 107. The nonlinear amplifier 70 connects the resistor 109 to a cathode of the zener diode 108.

Figure 10:
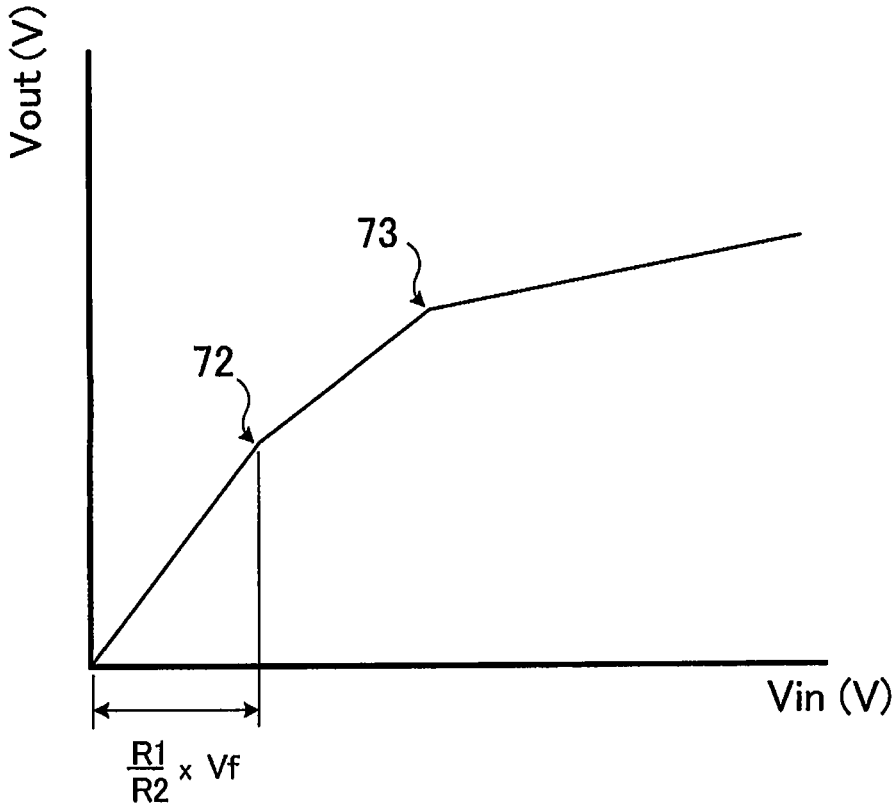
FIG. 10 is a diagram illustrating an example of an amplification characteristic of the nonlinear amplifier used in the image forming apparatus according to the second embodiment.

FIG. 10 is a diagram illustrating an example of the amplification characteristic of the nonlinear amplifier 70. The nonlinear amplifier 70 has a nonlinear amplification characteristic having two inflection points 72 and 73.

The nonlinear amplifier 70 enlarges and corrects a variation amount of a sensor value of the attached toner amount sensor 19.

The amplification characteristic is indicated by a voltage straight line which is expressed by Equation (b), $Vout=Vf+\{1+(R3/R1)\}\times Vin$, from the origin to the inflection point 72 ($Vin=(R1/R2)\times Vf$).

R1 denotes a resistance value of the resistor 101, R2 denotes a resistance value of the resistor 102, and Vf denotes a forward voltage of the diode 104.

An amplification factor when a sensor output voltage which is input from the attached toner amount sensor 19 has a value in a range from the inflection point 72 to the inflection point 73 is different from an amplification factor when the sensor output voltage has a value in a range located on the right side of the inflection point 73. The amplification factor of the nonlinear amplifier 70 with respect to the sensor output voltage is nonlinear.

The MFP 10 having this configuration detects an attached toner amount by substantially the same method as in the example shown in FIG. 6.

As shown in FIGS. 9 and 10, the nonlinear amplifier 70 amplifies a signal by using a large gain in a range of the sensor output voltage having a small value ($Vin=(R1/R2)\times Vf$ or less).

If the attached toner amount sensor 19 outputs a voltage signal exceeding an input value of the inflection point 72, the diode 104 clips a signal amplified by the nonlinear amplifier 70. A gain of the nonlinear amplifier 70 decreases.

In addition, if a voltage from the attached toner amount sensor 19 has a value exceeding the inflection point 73, the nonlinear amplifier 70 has a characteristic in which contributions of the zener diode 108 and the resistor 109 are added to the characteristic of the nonlinear amplifier 20.

The contributions indicate that the resistor components between the inverting input terminal 105 and the output terminal 107 have parallel influence on the voltage Vin by the serial connection of the zener diode 108 and the resistor 109.

The zener diode 108 and the resistor 109 contribute to the operational amplifier 100 by the parallel connection to the group of the resistors 102 and 103 and the diode 104.

If the voltage Vin is low, a current does not flow through the line of the zener diode 108 and the resistor 109.

The input voltage Vin increases. The output voltage Vout exceeds the breakdown voltage of the zener diode 108 at the inflection point 73. Shunting occurs between the inverting input terminal 105 and the output terminal 107 via the resistor 109. If exceeding the inflection point 73, the total gain of the nonlinear amplifier 70 decreases.

It is possible to enlarge a variation amount at a side where an attached toner amount is large in a monotonously decreasing range and detect an image density with high accuracy.

The nonlinear amplifier 70 may connect the resistor 109 to the anode of the zener diode 108.

The nonlinear amplifier 70 may have a modified configuration.

Figure 11:
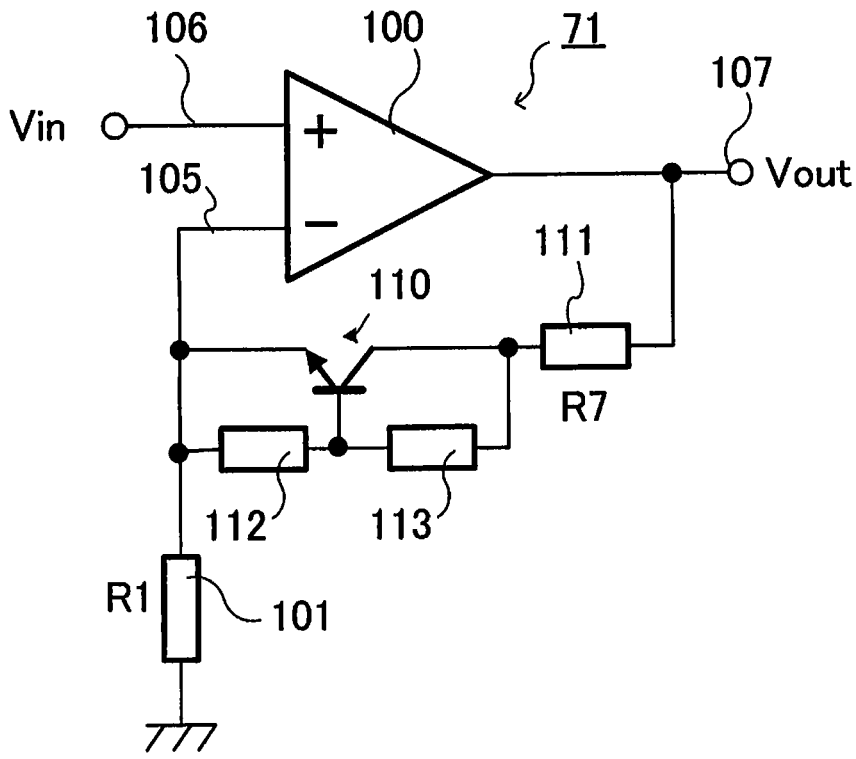
FIG. 11 is a diagram illustrating a configuration example of a nonlinear amplifier used in an image forming apparatus according to a modified example of the second embodiment.

FIG. 11 is a diagram illustrating a configuration example of another nonlinear amplifier used in an image forming apparatus according to a modified example of the second embodiment. The above-described reference numerals denote the same elements in the figure.

The nonlinear amplifier 71 includes a transistor 110 (clipping element), a resistor 111 (seventh resistor), and other resistors 112 and 113 for DC bias of the transistor 110.

An output voltage Vout from the nonlinear amplifier 71 increases. The transistor 110 as a clipping circuit clips the output voltage signal.

Shunting occurs between the inverting input terminal 105 and the output terminal 107. If exceeding the inflection point 73, the total gain of the nonlinear amplifier 71 decreases so as to be substantially the same as the amplification characteristic in FIG. 10.

OTHER EMBODIMENTS

The nonlinear amplifier 20 may have inflection points more than 2. For example, it is possible to increase inflection points by connecting a diode or a transistor in parallel between the inverting input terminal 105 and the output terminal 107.

Although the example where a sensor detection signal is input to the non-inverting input terminal of the nonlinear amplifier 20 has been described in the embodiments, in a manner similar thereto, a configuration where a sensor detection signal is input to the inverting input terminal of the nonlinear amplifier 20 may be used.

A method of applying bias in the nonlinear amplifier 20 and the like may be variously modified. The attached toner amount sensor 19 may be provided for each color.

The pattern shown in FIG. 7A is only an example, and the MFP 10 may variously modify the pattern. The advantage which the image forming apparatus according to the embodiments has over implementation products which implement a toner image for pattern through mere alterations of shapes, sizes, arrangements and the like is not damaged at all.

In the above-described embodiments, the MFP 10 has the four image forming portion 22Y and the like in tandem. The belt 21 places a pattern of four colors thereon.

The image forming apparatus according to the embodiments may use a direct color transfer method. The image forming apparatus has the chargers, the laser exposure device, and the developers for four colors at a total of twelve parts along the circumferential directions of the outer circumferential surfaces of the photoconductive drums.

In the image forming apparatus, patterns may be formed on the photoconductive drums, and the attached toner amount sensor 19 may measure an attached toner amount from each pattern.

The image forming apparatus may be a copier or a printer.

The MFP 10 may use, for example, an amplifier having a logarithmic amplification characteristic as a nonlinear amplifier, but there are cases where an operation of the amplifier is unstable. Further, in the logarithmic amplifier, a variation amount for a high density is small. The image forming apparatus according to the embodiments has no unstable operation due to the use of the logarithmic amplifier.

While certain embodiments have been described, these embodiments have been presented by way of example only, and are not intended to limit the scope of the inventions. Indeed, the novel methods and systems described herein may be embodied in a variety of other forms; furthermore various omissions and substitutions and changes in the form of methods and systems described herein may be made without departing from the spirit of the inventions. The accompanying claims and their equivalents are intended to cover such forms or modifications as would fall within the scope and spirits of the inventions.

What is claimed is:

1. An image forming apparatus comprising:

a photoconductor operable to rotate;

a latent image forming portion configured to electrically charge the photoconductor and forms an electrostatic latent image on a surface of the photoconductor;

an image processing portion configured to generate image data or pattern data;

a developer configured to develop the electrostatic latent image of the image data or the pattern data using toner;

a transferred body configured to have a surface onto which a toner image on the photoconductor is transferred;

a sensor configured to detect an image density of the toner image according to the amount of toner attached to the surface, and have a sensor characteristic in which a sensor output substantially monotonously decreases according to an increase in the amount of toner;

a nonlinear amplifier configured to have a nonlinear amplification characteristic having one or more inflection points, and enlarge and correct a value read by the sensor in a range where the sensor output monotonously decreases with respect to the amount of toner by amplification; and an image quality control portion configured to control forming conditions of the electrostatic latent image by the latent image forming portion, using a correction value of a variation amount of the value read by the sensor, the value being output from the nonlinear amplifier, at a side where the amount of toner is large in the range.

2. The apparatus of claim 1, wherein the nonlinear amplifier includes:

an operational amplifier that has a non-inverting input terminal to which the sensor output is input, an output terminal from which an amplified signal is output, and an inverting input terminal to which a feedback signal from the output terminal is input;

a first resistor that has one end connected to the inverting input terminal and the other end connected to a ground;

second and third resistors that are connected in series to each other between the inverting input terminal and the output terminal; and a clipping element that is disposed between a first connection point of the second resistor and the third resistor and a second connection point of the inverting input terminal and the first resistor, and switches between conduction and non conduction due to the voltage level.

3. The apparatus of claim 2, wherein the clipping element is a diode of which an anode is connected to the first connection point and a cathode is connected to the second connection point.

4. The apparatus of claim 3, wherein the nonlinear amplifier outputs a feedback voltage determined by values of the first resistor, the second resistor, and the third resistor, if a level of the sensor output is relatively low; and the diode clips the amplified signal, and the nonlinear amplifier outputs the feedback voltage determined by a forward voltage of the diode, and values of the first resistor and the third resistor, if the level of the sensor output is relatively high.

5. The apparatus of claim 1, wherein the nonlinear amplifier comprises:

an operational amplifier that has a non-inverting input terminal to which the sensor output is input, an output terminal from which an amplified signal is output, and an inverting input terminal to which a feedback signal from the output terminal is input;

a first resistor that has one end connected to the inverting input terminal and the other end connected to a ground;

at least one fourth resistor that is connected between a connection point of the inverting input terminal and the first resistor, and the output terminal;

a clipping element that is disposed between the connection point of the inverting input terminal and the first resistor, and the output terminal, and switches between conduction and non conduction due to the voltage level; and a fifth resistor that is disposed between the connection point and the output terminal and is connected in series to the clipping element.

6. The apparatus of claim 1, wherein the nonlinear amplifier comprises:

an operational amplifier that has a non-inverting input terminal to which the sensor output is input, an output terminal from which an amplified signal is output, and an inverting input terminal to which a feedback signal from the output terminal is input;

a first resistor that has one end connected to the inverting input terminal and the other end connected to a ground;

second and third resistors that are connected in series to each other between the inverting input terminal and the output terminal; and a clipping element that is disposed between a first connection point of the second resistor and the third resistor and a second connection point of the inverting input terminal and the first resistor, and switches between conduction and non conduction due to the voltage level, a zener diode that has an anode directing toward the second connection point and a cathode directing toward the output terminal; and a sixth resistor that is disposed between the output terminal and the second connection point and is connected in series to the zener diode.

7. The apparatus of claim 6, wherein the clipping element is a diode of which an anode is connected to the first connection point and a cathode is connected to the second connection point.

8. The apparatus of claim 7, wherein the nonlinear amplifier outputs a feedback voltage determined by values of the first resistor and the second resistor, and a forward voltage of the diode, if a level of the sensor output is in a range from an origin to a first inflection point;

the nonlinear amplifier performs saturated amplification, and the diode clips the amplified signal, if the level is higher than the first inflection point and lower than a second inflection point; and the nonlinear amplifier shunts a partial voltage of the feedback voltage to the zener diode if the level exceeds the second inflection point.

9. The apparatus of claim 1, wherein the nonlinear amplifier comprises:

an operational amplifier that has a non-inverting input terminal to which the sensor output is input, an output terminal from which an amplified signal is output, and an inverting input terminal to which a feedback signal from the output terminal is input;

a first resistor that has one end connected to the inverting input terminal and the other end connected to a ground;

a clipping element that is disposed between a connection point of the inverting input terminal and the first resistor, and the output terminal, and switches between conduction and non conduction due to the voltage level; and a seventh resistor that is disposed between the output terminal and the connection point and is connected in series to the clipping element.

10. The apparatus of claim 1, wherein the image quality control portion is configured to control a developing bias in the developer.

11. The apparatus of claim 1, wherein the latent image forming portion configured to have a charger which electrically charges the photoconductor, and the image quality control portion configured to control a charging potential on the surface of the photoconductor by the charger.

12. The apparatus of claim 1, wherein the latent image forming portion is configured to have a laser exposure device which irradiates the photoconductor with laser beams, and the image quality control portion configured to control an intensity of the laser beams from the laser exposure device.

13. The apparatus of claim 1, wherein the sensor configured to detect a light amount of reflection light beams from the toner image.

14. The apparatus of claim 1, wherein the sensor characteristic of the sensor has a shape where the sensor output protrudes downwardly with respect to an increase in the amount of toner.

15. An image quality control method comprising:

developing an electrostatic latent image of image data or pattern data on a surface of a photoconductor using toner;

detecting an image density of a toner image based on the amount of toner, by a sensor having a sensor characteristic with a relationship between the amount of toner and a sensor output, the relationship being that the sensor output substantially monotonously decreases according to an increase in the amount of toner;

enlarging and correcting a value read by the sensor in a range where the sensor output monotonously decreases with respect to the amount of toner by amplification in a nonlinear amplifier which has a nonlinear amplification characteristic having one or more inflection points; and controlling forming conditions of the electrostatic latent image, by an enlarged variation amount of the value read by the sensor at a side where the amount of toner is large in the range.

16. The method of claim 15, wherein the enlarging and correcting of the value read by the sensor comprises:

outputting a feedback voltage determined by values of a first resistor, a second resistor, and a third resistor, if a level of the sensor output is relatively low; and clipping the amplified signal, and outputting the feedback voltage determined by a forward voltage of a diode, and values of the first resistor and the third resistor, if the level of the sensor output is relatively high.

17. The method of claim 15, wherein the enlarging and correcting of the value read by the sensor comprises:

outputting a feedback voltage determined by values of a first resistor and a second resistor, and a forward voltage of a diode, if a level of the sensor output is in a range from an origin to a first inflection point;

clipping the amplified signal by saturated amplification, if the level is higher than the first inflection point and lower than a second inflection point; and shunting a partial voltage of the feedback voltage, if the level exceeds the second inflection point.

18. The method of claim 15, wherein the detecting of the image density of the toner image comprises:

detecting a light amount of reflection light beams of light beams applied to the toner image.

19. The method of claim 15, wherein the detecting of the image density of the toner image comprises:

using the sensor characteristic having a shape where the sensor output protrudes downwardly with respect to an increase in the amount of toner.

20. The method of claim 15, wherein the detecting of the image density of the toner image comprises:

detecting the amount of toner attached to one of a photoconductor and a transferred body.

* * * * *